US009750350B2

(12) United States Patent
Armbruster et al.

(10) Patent No.: US 9,750,350 B2
(45) Date of Patent: Sep. 5, 2017

(54) BOUNCING AND SWIVELING INFANT SUPPORT STRUCTURE

(71) Applicant: Mattel, Inc., El Segundo, CA (US)

(72) Inventors: Michael Armbruster, Grand Island, NY (US); Noah Mauer, Warsaw, NY (US); Chalin Yu, Williamsville, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 14/950,170

(22) Filed: Nov. 24, 2015

(65) Prior Publication Data

US 2017/0143134 A1 May 25, 2017

(51) Int. Cl.

| | |
|---|---|
| ***A63G 9/16*** | (2006.01) |
| ***A47D 1/00*** | (2006.01) |
| *A47D 9/00* | (2006.01) |

(52) U.S. Cl.

CPC ..... *A47D 1/002* (2013.01); *A47D 1/004* (2013.01)

(58) Field of Classification Search

CPC ... A63G 9/00; A63G 9/02; A63G 9/16; A47D 9/00; A47D 9/02; A47C 1/00

USPC ..... 472/118–119; 297/260.1, 260.2, 259.1, 297/325, 329, 344.17, 344.1

See application file for complete search history.

(56) References Cited

U.S. PATENT DOCUMENTS

| | | | | |
|---|---|---|---|---|
| 4,752,980 | A | 6/1988 | Nafte | |
| 5,022,708 | A | 6/1991 | Nordella et al. | |
| 5,257,851 | A | 11/1993 | Kanaya | |
| 5,711,045 | A | 1/1998 | Caster et al. | |
| 7,563,170 | B2 | 7/2009 | Bellows et al. | |
| 7,607,734 | B2 | 10/2009 | Clapper et al. | |
| 7,614,930 | B2 | 11/2009 | Berkey et al. | |
| 7,717,798 | B2 | 5/2010 | Bellows et al. | |
| 7,722,118 | B2 | 5/2010 | Bapst et al. | |
| 7,727,078 | B2 | 6/2010 | Arnold, IV et al. | |
| 7,748,063 | B2 | 7/2010 | Chen et al. | |
| 7,770,971 | B2 | 8/2010 | Bellows et al. | |
| 7,789,762 | B2 | 9/2010 | Greger et al. | |
| 7,824,273 | B2 | 11/2010 | Clapper et al. | |
| 7,845,728 | B2 | 12/2010 | Chen et al. | |
| 7,874,927 | B2 | 1/2011 | Godiska | |
| 7,883,426 | B2 | 2/2011 | Bellows et al. | |
| 7,884,710 | B2 | 2/2011 | Godiska et al. | |
| 7,918,742 | B2 | 4/2011 | Clapper et al. | |
| 7,938,731 | B2 | 5/2011 | Papageorge et al. | |
| 8,029,377 | B2 | 10/2011 | Velderman et al. | |
| 8,047,609 | B2 | 11/2011 | Chen et al. | |
| 8,187,111 | B2 | 5/2012 | Velderman et al. | |
| 8,197,005 | B2 * | 6/2012 | Hopke ..... | A47C 1/00 297/260.2 |

(Continued)

*Primary Examiner* — Kien Nguyen

(74) *Attorney, Agent, or Firm* — Edell, Sahpiro & Finnan, LLC

(57) ABSTRACT

An infant support structure is disclosed. The infant support structure includes a support base to support the infant support structure on a supporting surface. The infant support structure also includes a seat supported by the support base at a distance above the supporting surface, a lift mechanism configured to selectively impart vertical movement to the seat, and a rotation mechanism configured to, independently of the lift mechanism, rotate the seat about a pivot point. The lift mechanism is configured to allow rotational movement to be imparted to the seat while the seat is undergoing vertical movement.

18 Claims, 13 Drawing Sheets

(56) References Cited

U.S. PATENT DOCUMENTS

| | | | | |
|---|---|---|---|---|
| 8,239,984 | B2 | 8/2012 | Hopke et al. | |
| 8,661,582 | B2 * | 3/2014 | Sclare | A47D 9/02 472/118 |
| 8,684,856 | B2 | 4/2014 | Pyrce et al. | |
| 8,845,440 | B2 * | 9/2014 | Haut | A47D 13/10 472/119 |
| 2006/0012230 | A1 | 1/2006 | Kennedy et al. | |
| 2007/0267904 | A1 * | 11/2007 | Clapper | A47D 9/02 297/256.16 |
| 2008/0136236 | A1 | 6/2008 | Kincaid et al. | |
| 2008/0146359 | A1 | 6/2008 | Godiska | |
| 2008/0146361 | A1 | 6/2008 | Godiska | |
| 2010/0127539 | A1 | 5/2010 | Bellows et al. | |
| 2010/0159428 | A1 | 6/2010 | Grasing et al. | |
| 2012/0216351 | A1 | 8/2012 | Hopke et al. | |
| 2013/0184088 | A1 | 7/2013 | Haut | |
| 2013/0229040 | A1 | 9/2013 | Mountz | |
| 2013/0244803 | A1 * | 9/2013 | Haut | A47D 13/105 472/119 |
| 2014/0018179 | A1 | 1/2014 | Mountz et al. | |
| 2014/0287846 | A1 * | 9/2014 | Mountz | A47D 9/02 472/118 |

* cited by examiner

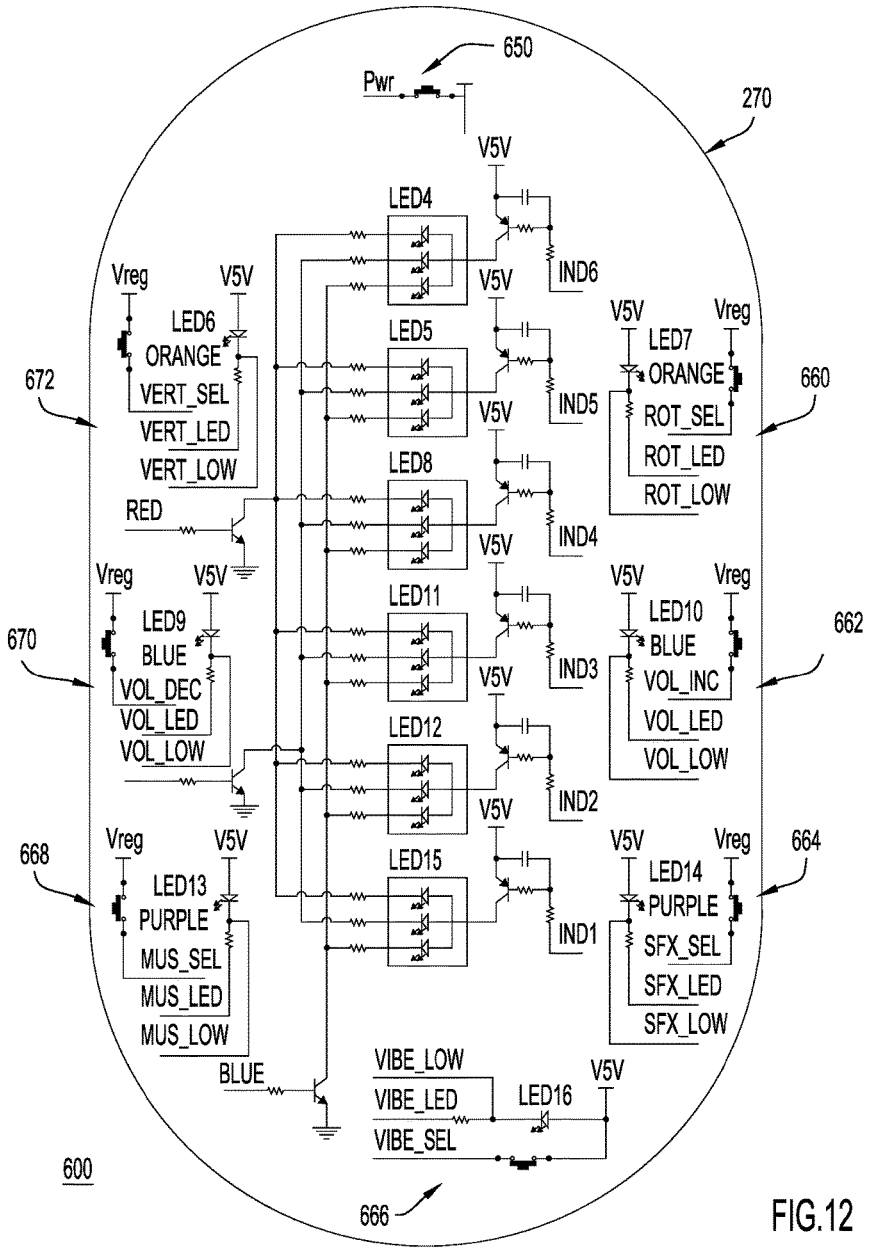
FIG.12
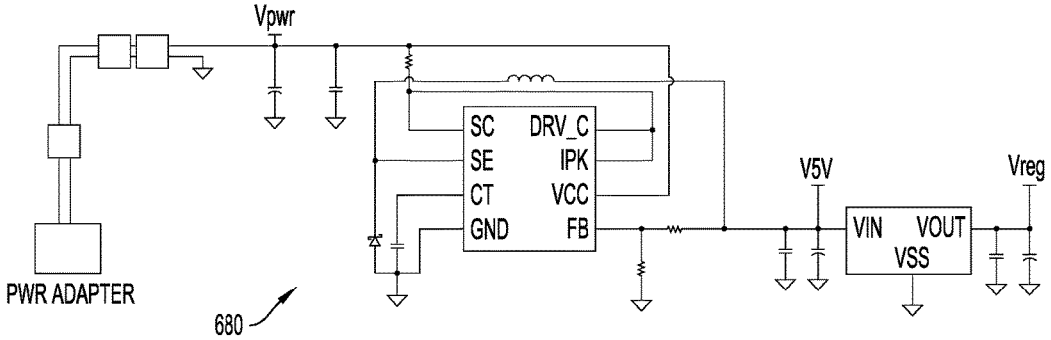

BOUNCING AND SWIVELING INFANT SUPPORT STRUCTURE

FIELD OF THE INVENTION

The present invention is directed toward an infant support structure and, in particular, an infant support structure that can impart swiveling, bouncing, and vibrational movement to a child seated within the infant support structure

BACKGROUND OF THE INVENTION

Infant support structures, which may also be referred to as infant seats, are often used to soothe a restless child. For example, bouncers and swings provide a gentle rocking motion to the seat, comforting an infant positioned therein. Some seats also provide gliding motion or various motion pathways. However, infants may be quite particular as to which motion they prefer and often simply prefer to be held by a moving caregiver. Accordingly, infant support structures that produce new, interesting, and soothing motion paths are desired.

SUMMARY OF THE INVENTION

The present invention generally relates to an infant support structure that imparts bouncing and/or swiveling motion to a child. Moreover, the infant support structure provided herein may also impart vibrational motion to a child along with the bouncing and/or swiveling motion. According to at least one exemplary embodiment, an infant support structure according to the present invention includes a support base to support the infant support structure on a supporting surface. The infant support structure also includes a seat supported by the support base at a distance above the supporting surface, a lift mechanism configured to selectively impart vertical movement to the seat, and a rotation mechanism configured to, independently of the lift mechanism, reciprocally rotate the seat about a pivot point. The lift mechanism is configured to allow rotational movement to be imparted to the seat while the seat is undergoing vertical movement.

BRIEF DESCRIPTION OF THE DRAWINGS

FIGS. 11 and 12 illustrate schematic diagrams of an electronics assembly included in the infant support structure, according to an exemplary embodiment of the present invention.

Like reference numerals have been used to identify like elements throughout this disclosure.

DETAILED DESCRIPTION OF THE INVENTION

In accordance with the present invention, an infant support structure is disclosed. Generally, the infant support structure is configured to receive an infant in a seated or supine position and impart swiveling (i.e., rotational movement in the XY-plane), bouncing (i.e. vertical movement), and/or vibrational movement to the infant. In order to impart the bouncing, swiveling, and vibrational movement to a child, the infant support structure includes a movement mechanism with a lift mechanism and a rotation mechanism. The lift mechanism is included on a carriage that includes a wheeled base. The wheeled base is configured to swivel, or rotate, about a central pivot point or axis when moved by the rotation mechanism. Moreover, a vibration mechanism may be incorporated into the movement mechanism to provide vibrational movement in conjunction with any swiveling or bouncing movement. Incorporating the vibration mechanism into movement mechanism, rather than it's inclusion as a totally separate element, may allow the vibration mechanism to receive power from the same power source as the lift mechanism and the rotational mechanism, such as an outlet, and allow the infant support structure to be fully functional without including a second power source for the vibration mechanism, such as batteries.

The unique combination of movements provided by the infant support structure disclosed herein enable the infant support structure to substantially recreate many common motion paths used by caregivers to attempt to soothe a child in their arms. The lift mechanism may substantially recreate the motion imparted to a child when a caregiver bounces a child in their arms up and down and the rotation mechanism may substantially recreate the motion imparted to a child when a caregiver rocks a child in their arms (i.e., swivels his or her arms and torso about his or her spine). In some embodiments, the infant support structure provided herein includes a communication module configured to communicate with a mobile electronic device in order to receive a motion path. For example, if a caregiver holds their mobile electronic device while soothing their child (i.e., bouncing or swiveling), the infant structure may later recreate the motion path of the mobile electronic device. The accelerometer, gyroscope, or other motion detection device in the caregiver's mobile electronic device, via an app, could record the motion path/pattern provided to the child while in the caregiver's arms and transmit that motion pattern to the infant support structure to later recreate that same motion path/pattern for a child received in the infant support structure.

Figure 1:
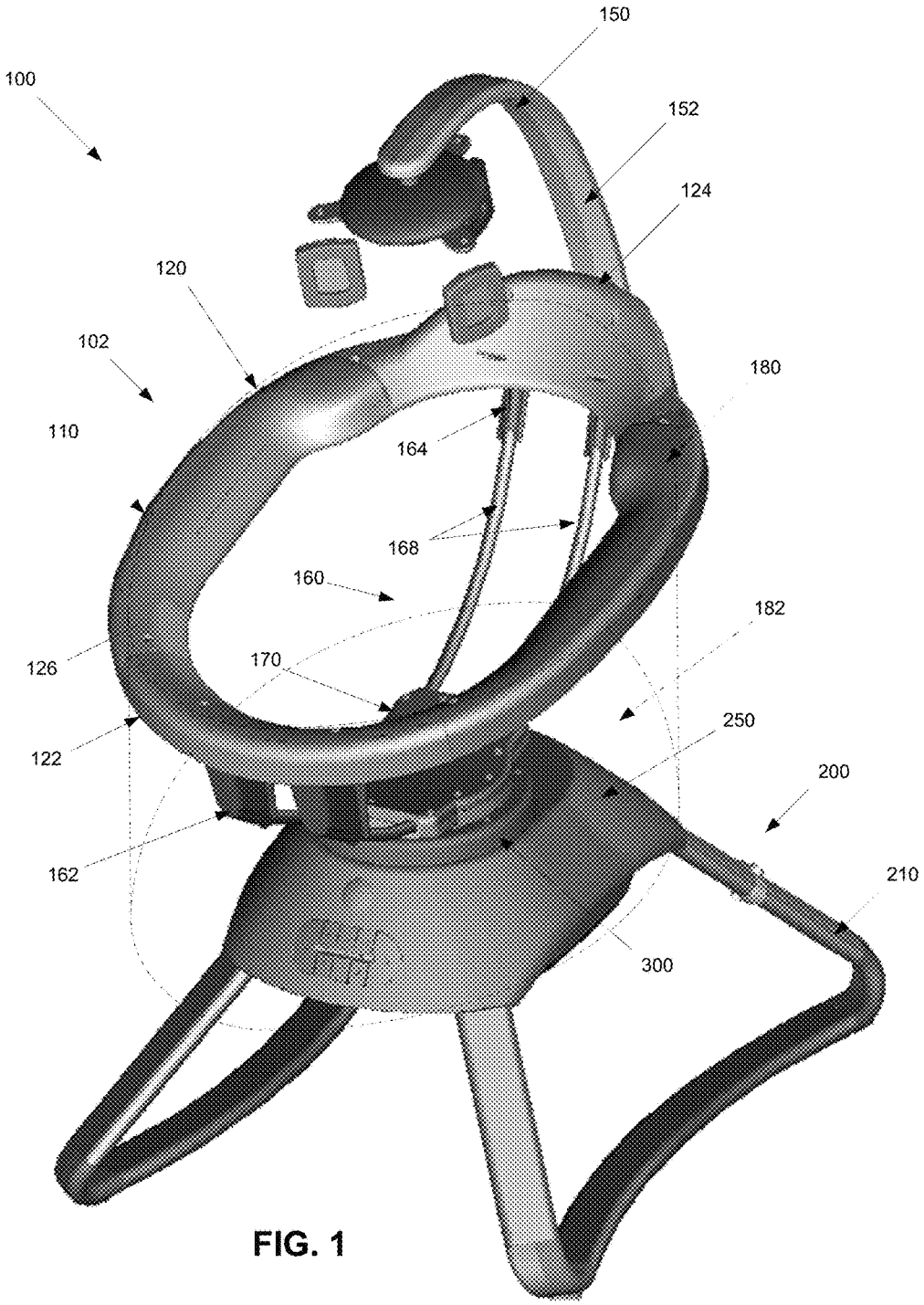
FIG. 1 illustrates a front perspective view of a bouncing and swiveling infant support structure according to an exemplary embodiment of the present invention.

Now referring to FIG. 1, a perspective view of an infant support structure 100 according to an example embodiment of the present invention is shown. The infant support structure 100 includes seat 102 and support base 200. The support base 200 includes legs 210, a housing 250, and a carriage 300 that is at least partially movably enclosed within the housing 250. The carriage 300 includes at least a portion of a movement mechanism 400 and the seat 102 is configured to be mounted on the carriage 300 such that any movement imparted to the carriage 300 by the movement mechanism 400 (see FIG. 2), such as swiveling/twisting motion, vertical/bouncing movement, or vibrational movement is transferred to the seat 102. In particular, the seat 102 is mounted atop of the carriage 300 such that any motion imparted to the seat 102 is imparted from components of the infant structure 100 disposed beneath the seat 102

In FIG. 1, the seat 102 is shown without a soft goods covering for clarity. The seat 102 includes a frame 110 that includes an upper section 120 and a lower section 160. In this embodiment, the upper frame section 120 includes four arcuate bars 126 that form a substantially elliptical frame 110 that extends from a first end 122 to a second end 124. However, in other embodiments, the upper frame section 120 may be formed from two U-shaped bars or any other parts, provided the upper frame section 120 is configured to receive a softgoods cover (not shown for transparency) that provides a seating region capable of supporting an infant in a seated and/or a supine position.

For example, although a softgoods covering is not shown in FIG. 1, in some embodiments, softgoods material may be draped over and secured to the upper section 120 of the frame 110. The frame 110 may be formed from generally rigid material including, but not limited to, metal and plastic to provide a sturdy mounting point and the softgoods material (e.g., a soft fabric formed from natural or synthetic materials) may be draped over and secured to the upper frame section 120 to provide a seating region capable of supporting an infant in a seated and/or a supine position. Additionally or alternatively, the softgoods material may be designed to fit securely and snugly onto any portions of the frame 110. For example, the seating region may extend downwards through the upper frame section 120 towards the lower frame section 160 and may conform and/or be secured to the lower frame section 160 as well as the upper frame section 120. The softgoods material, moreover, may be removable and washable. Attentively, in other embodiments, the frame 110 may be configured to receive any seat or provide a seat itself, if desired.

Still referring to FIG. 1, the upper frame section 120 is also coupled to at least one connecting rod 168 included in the lower section 160 at the first and second ends 122, 124. Each connecting rod 168 is disposed substantially beneath bars 126 and extends from the front end 122 to the rear end 124. In the particular embodiment depicted in FIG. 1, the at least one connecting rod 168 includes two arcuate rods. Thus, the at least one connecting rod 168 and bars 126 collectively form the skeleton of a seat 102 that a material, such as a softgoods material, can be draped over to form a comfortable seat for a child. Furthermore, each of the at least one connecting rods 168 may be movably mounted to or captured within a portion of the support base 200 of seat 100 to allow the seat 102 to be supported above the support base 200 and/or recline with respect to the support base 200.

In the embodiment depicted in FIG. 1, the connecting rods 168 are movably secured within a recline mechanism 170 which is fixedly secured to the carriage 300 and, in particular, fixedly secured atop of the carriage 300. The recline mechanism 170 may allow the seat 102 may be rotated (i.e. reclined) or moved between various positions with respect to the carriage 300 and/or support base 200 so that the seat 102 may be moved between a position that receives an infant in an upright position and a position that receives an infant in a supine/reclined position. Additional details regarding the recline mechanism 170 of the infant support structure 100 are provided in U.S. Published Patent Application No. 2015/0289677 (Huntsberger et al.), the disclosure of which is herein incorporated by reference in its entirety. In other embodiments, the seat 102 may be fixedly coupled to the carriage 300 and/or support base 200 without a recline mechanism or in any other desirable manner. However, the seat 102 is preferably coupled to the carriage 300 in a manner that allows the seat 102 to be locked in place with respect to the carriage 300 during use such that any movement imparted to the carriage 300 is translated to the seat 102.

In the embodiment shown in FIG. 1, the lower frame section 160 also includes a first coupler 162 and a second coupler 164 which couple the connecting rods 168 of the lower frame section 160 to the upper frame section 120. In some embodiments, the couplers 162, 164 may simply serve to ensure that the lower frame section 160 remains coupled to the upper frame section 120. However, in other embodiments, the couplers 162, 164 may also couple the bars 126 of the upper frame section 120 together. Moreover, in some embodiments, the seat 102 may also includes handles (not shown) to allow a parent to easily move the infant support structure 100 and/or turn the seat 102 with respect to the support base 200, if desired. Any handles included in the upper frame section 120 may also serve to couple the bars 126 together, either together with or instead of the couplers 162, 164.

In at least some embodiments, the frame 110 substantially defines the boundaries or periphery of the seat 102, including a lateral periphery 180 (shown in dashed lines (- - -)). Any components of the infant support structure 100 described as being disposed within the lateral periphery of the seat 102 are disposed within a space, such as space 182 (defined by lines formed with two dots and a dash (- . . -)), that is vertically aligned with the seat 102 (i.e., above or below the seat 102). As an example, in the depicted embodiment, the carriage 300 is within space 182, below the seat 102, and, thus, disposed within the lateral periphery 180 of the seat 102. By comparison, in the depicted embodiment, a portion of the support base 200 is disposed within space 182 and, thus, a portion of the support base 200 is disposed within the lateral periphery 180 of the seat 102 while another portion of the support base 200 extends beyond (i.e., is not be disposed within) the lateral periphery 180 of the seat 102.

In some embodiments, different portions of the infant support structure 100 may be disposed within the lateral periphery 180 as the seat 102 swivels or moves. For example, the seat 102 may be vertically aligned with different portions of the support base 200 as the seat 102 swivels with respect to the support base 200. However, at least a portion of the carriage 300, up to and including all of the carriage 300, may be continuously disposed within the lateral periphery 180 of the seat since the seat 102 pivots about a point (or included in) the carriage 300, as is described in further detail below. That being said, in some embodiments, a portion of the carriage 300 may also extend beyond the lateral periphery 180 of the seat 102 when the seat 102 is moved or swiveled to different positions.

Still referring to FIG. 1, the seat 100 may also include a toy mobile 150. The toy mobile 150 may be mounted to the seat 102 adjacent the second end 124 such that the mobile 150 may extend over and above a child's head when the child is disposed in the seat. In some embodiments, the mobile 150 may include lights, sounds, or movements, and any components required to provide these functions may be installed or supported on a portion of the mobile 150 (i.e., the mobile arm 152), on the frame 110 adjacent the second end 124, such as on the coupler 164, and/or within the support base 200. The mobile 150, moreover, may be removable and/or interchangeable with other infant entertainment apparatuses.

Figure 2:
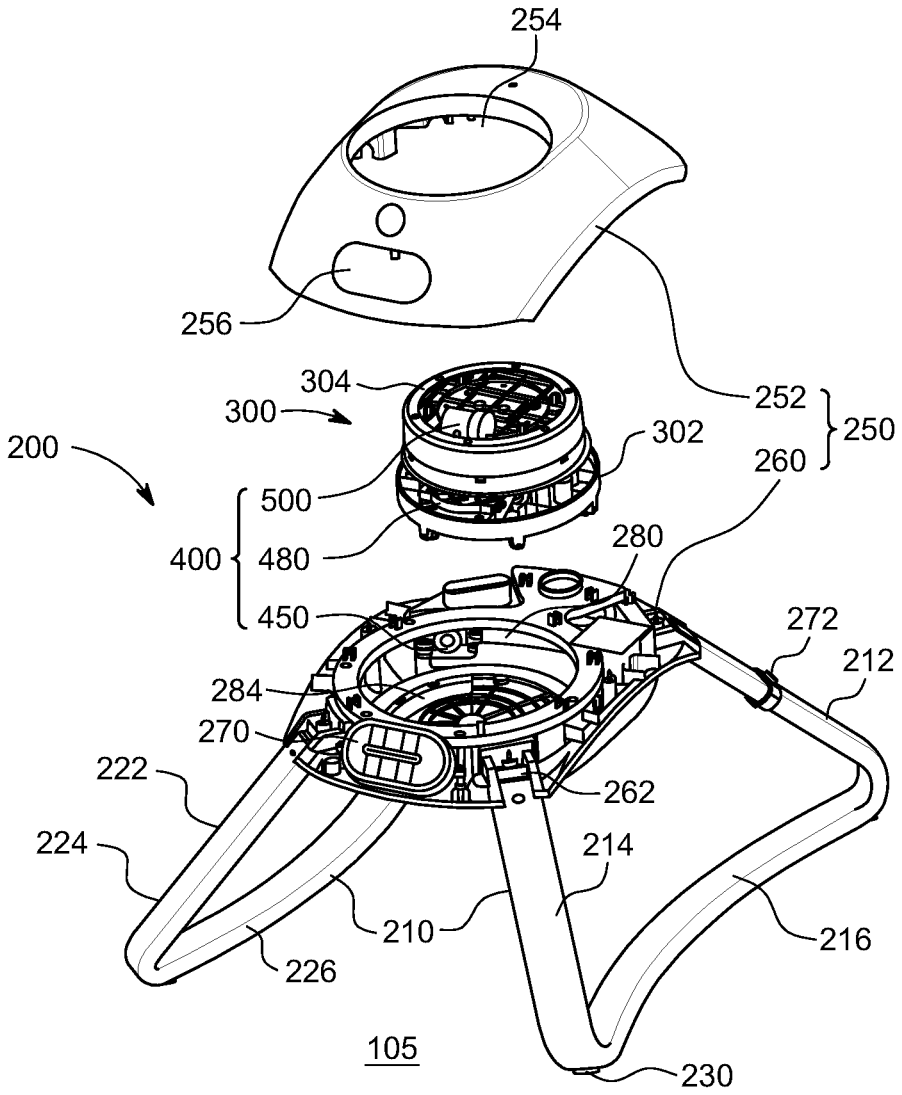
FIG. 2 illustrates an exploded front perspective view of a support base from the infant support structure of FIG. 1.

Now referring to FIG. 2, an exploded view of the support base 200 illustrates at least some of the interplay between the legs 210, the housing 250, the carriage 300, and the movement mechanism 400. Generally, the support base 200 is configured to support the seat 102, as well as the housing 250 and carriage 300, at a distance above a supporting surface 105. For example, the seat 102 is mounted atop the support base 200 and is moved by portions of the support base 200 disposed beneath the seat 102. The housing 250 includes an upper housing 252 and a lower housing 260 that extend around an interior cavity 280. The legs 210 extend downwards from the lower housing 260 to stably support housing 250 a distance above the supporting surface 105.

In the depicted embodiment, the legs 210 include a first leg 212 and a second leg 222. Each of leg 212 and leg 222 is substantially U-shaped. The first leg 212 includes two uprights 214 and a substantially horizontal support 216 that extends therebetween. Similarly, the second leg 222 includes two uprights 224 and a substantially horizontal support 226 that extend therebetween. The uprights 214, 224 are received in receivers 262 included in the lower housing 260 and fixedly secured thereto, such as with a valco snap button. Moreover, the uprights 214, 224 extend downwards from the lower housing 260 at an angle so that the legs 210 widen and increase the stability of the support base 200. In some embodiments, the legs 210 may also include feet 230, which may serve to discourage the legs 210 from sliding or tipping on a supporting surface 105. The feet 230 may be disposed at each corner of the legs 210 (i.e., where the uprights 214, 224 meet the horizontal supports 216, 226).

Still referring to FIG. 2, the interior cavity 280 provided within the lower housing 260 and upper housing 252 provides ample space so that the carriage 300 can sit substantially within the housing 250. The carriage 300 sits on a track 284 disposed within the lower housing 260 and extends up and through a top opening 254 in the upper housing 252. The carriage 300 extends through the top opening 254 so that the seat 102 can be mounted atop the carriage 300 in the manner described above with respect to FIG. 1 (i.e., via recline mechanism 170).

The movement mechanism 400 is also disposed substantially within the interior cavity 280. The movement mechanism 400 includes a lift mechanism 480, and a vibration mechanism 500 that are disposed in or on the carriage 300 and a rotation mechanism 450 that is disposed in the lower housing 260. As is described in more detail below, the rotation mechanism 450 is configured to rotate or swivel the carriage 300 on the track 284. Meanwhile, the lift mechanism 480 and the vibration mechanism 500 are configured to impart movement to a top portion 304 of the carriage 300. For example, the lift mechanism 480 is configured to move the top portion 304 vertically with respect to a bottom portion 302 of the carriage 300.

Still referring to FIG. 2, the support base 200 may also include various controls and housings for electronics that may allow a caregiver to control various aspects of the infant support structure 100. For example, in this embodiment, the upper housing 252 includes a control panel opening 256 that may expose a control panel 270 included on the lower housing 260. The control panel 270 is explained in further detail below with regards to FIGS. 11-1312. Additionally, in some embodiments, the infant support structure 100 may include a wireless communication module which may allow a caregiver to control the infant support structure 100 remotely (i.e., access the functionality provided by the control panel 270) and/or to communicate with various applications or computing devices (i.e., a smartphone) to receive inputs regarding a motion path to be produced by the movement mechanism 400. Consequently, in some embodiments, the infant support structure may include an infrared (IR) receiver 272 on a portion of the legs 210. However, in other embodiments, any protocol or form of wireless communication, such as Bluetooth low energy (LE) may be utilized by the infant support structure 100.

Figure 3:
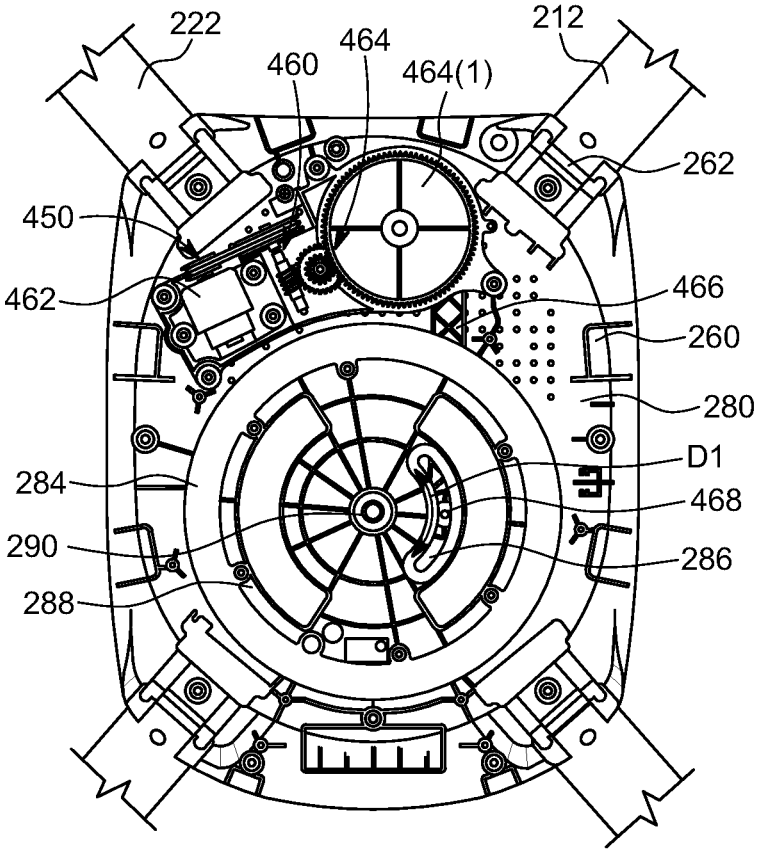
FIG. 3 illustrates a top perspective view of a lower housing included in the support base shown in FIG. 2.

Now referring to FIG. 3, a top perspective view of the lower housing 260 is shown with covers that shield or cover the rotation mechanism 450 removed for clarity. Reference is also made to FIG. 2 for the purposes of this description. The rotation mechanism 450 includes a drive mechanism 460 that includes a motor 462 and a gear assembly 464. The gear assembly 464 is configured to translate energy from the motor 462 into rotational movement that can drive (or cam) a cam arm 466 that is coupled to the drive mechanism 460. In the depicted embodiment, the gear assembly 464 includes a worm gear that receives energy from the motor 462 via a pulley system and drives a series of spur gears that may drive the cam arm 466. For example, the cam arm 466 may be fixedly coupled to an outer edge of a large spur gear 464(1) and be driven in a clockwise direction.

The other end of the cam arm 466 (i.e., the end opposite the drive mechanism 460) is movably secured within an arcuate slot 286 included in the track 284. In particular, the cam arm 466 extends under the track 284 and includes a pin 468 that extends through and may ride back and forth within the arcuate slot 286 in accordance with arrow D1 as the cam arm 466 is driven by the drive mechanism 460. Thus, if the pin 468 is coupled to the carriage 300, movement of the cam arm 466 may cause the carriage to reciprocally swivel back and forth on the track 284. For example, the carriage 300 may include wheels that may roll back and forth in a wheel path 288 that extend substantially around a central pivot point 290 on the track 284. The coupling and interaction between the carriage 300 and the rotation mechanism 450 is described in further detail below with regards to FIG. 4.

Figure 4:
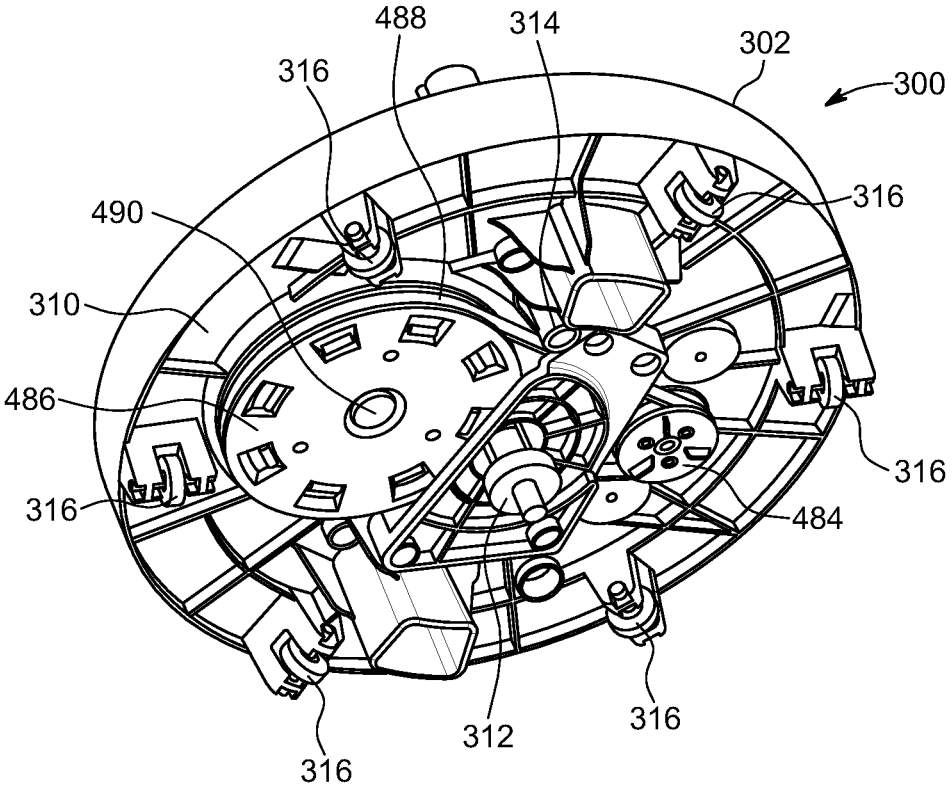
FIG. 4 illustrates a bottom perspective view of a portion of a carriage included in the support base shown in FIG. 2.

Now referring to FIG. 4, a bottom perspective view of the carriage 300 is shown such that a bottom surface 310 of the bottom portion 302 the carriage 300 is shown. The bottom surface 310 includes a central pivot 312 that is configured to engage the central pivot point 290 included in the track 284. When the pivot 312 engages the pivot point 290, the carriage 300 may be free to rotate about the pivot 312, but be prevented from moving within the X-Y plane while disposed on the track 284. Additionally, when the pivot 312 engages the pivot point 290, the pivot 312 and pivot point 290 are each vertically aligned with the carriage 300 and, thus, are vertically aligned with the seat 102. Consequently, when engaged, the pivot 312 and pivot point 290 are each disposed within the periphery of the seat 102.

The bottom surface 310 may also include a number of wheels 316 disposed around the central pivot 312 and a boss 314 configured to engage the pin 468 included on the cam arm 466. In this embodiment, wheels 316 includes six wheels spaced equilaterally around the periphery of the bottom surface 310 of the carriage 300 and each of the wheels 316 is arranged to align with a circle centered on the pivot 312. However, in other embodiments any number of wheels 316 spaced at any increments around the bottom surface 310 of the carriage 300 may be utilized.

The configuration of the carriage 300 and the track 284 allows the carriage 300 to be secured to the housing 250 while allowing rotational or swiveling movement of the carriage 300. For example, as the drive mechanism 460 of the rotational mechanism 450 drives the cam arm 466, the engagement between the pin 468 and the boss 314 may cause the carriage 300 to rotate or swivel back and forth (reciprocate) as wheels 316 roll back and forth on wheel track 288. Swiveling the carriage 300 in this manner may, in turn, impart swiveling motion to the seat 102. More specifically, when the carriage 300 (and seat 102) is rotated about pivot 312 and pivot point 290, the carriage 300 (and seat 102) is swiveled or rotated about a pivot point disposed within the lateral periphery of the seat 102.

Moreover, in some embodiments, the engagement between the pin 468 and boss 314 may also secure at least a portion of the carriage 300 to the housing 250, at least with respect to vertical and horizontal movement. In particular, the track 284 may be fixedly coupled to the lower housing 260 and, thus, coupling the rotation mechanism 450 to the carriage 300 through the track 284 (i.e. through slot 286) may couple the bottom portion 302 of the carriage 300 to the housing 260 in a manner that prevents horizontal and vertical movement of the bottom portion 302 with respect to the housing 250 (while allowing rotational movement).

Figure 5:
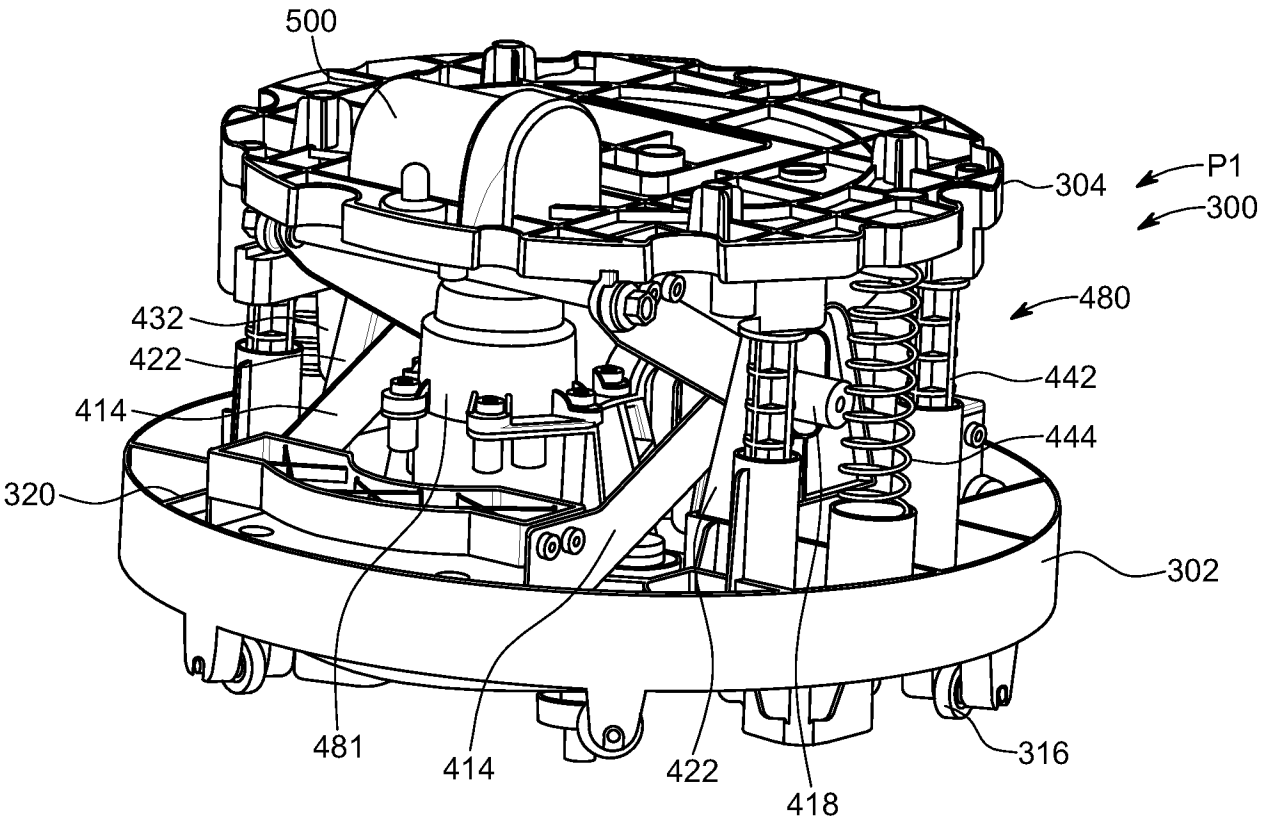
FIG. 5 illustrates a front perspective view of the carriage included in the support base shown in FIG. 2.

Still referring to FIG. 4, but now with reference to FIG. 5 as well, the bottom surface 310 of the bottom portion 302 of the carriage 300 also includes components of the lift mechanism 480. Specifically, the bottom surface 310 includes a small pulley 484 and a large pulley 486. The large pulley 486 is coupled to the carriage 300 with an axle 490 that extends through the bottom portion 302 of the carriage 300 in order to couple the large pulley 486 to components of the lift mechanism 480 included on a top surface 320 of the bottom portion 302 of the carriage. The small pulley 484 is coupled to a motor that may also extend through the bottom portion 302, as is described in further detail below. The small pulley 484 may be operatively coupled to the large pulley 486 with a band or belt 488 that extends around both of the small pulley 484 and the large pulley 486.

Figure 6:
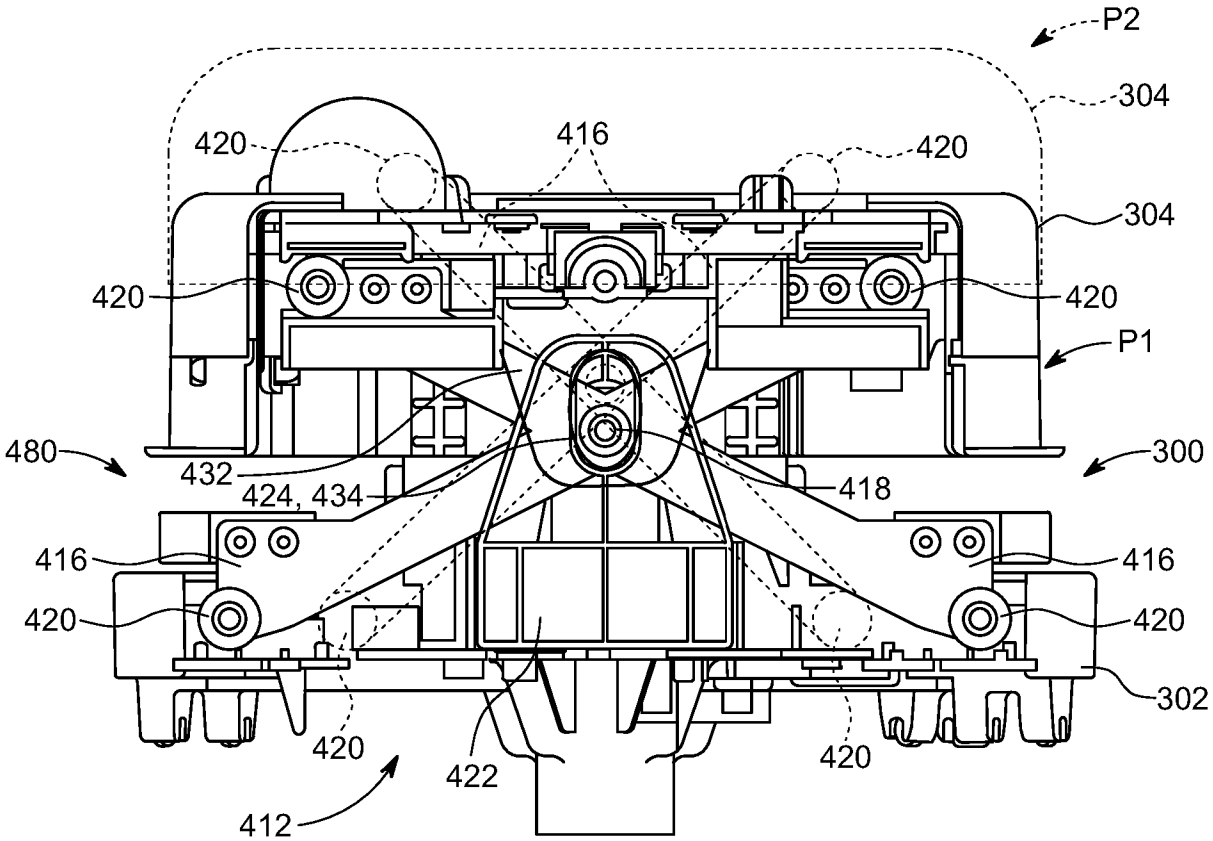
FIG. 6 illustrates a side, sectional view of the carriage shown in FIG. 5.

Now referring to FIGS. 5 and 6, the carriage 300 is shown from a top perspective view with sections of the top portion 304 removed for clarity and from a side sectional view, respectively. As mentioned, the lift mechanism 480 extends between the bottom portion 302 and the top portion 304 of the carriage 300. In the depicted embodiment, the lift mechanism 480 includes a scissor mechanism 412 that is coupled to the bottom portion 302 and the top portion 304 and extends therebetween. The scissor mechanism 412 is configured to move the top portion 304 between a lowered positioned P1 and a raised position P2 (shown in dashed lines in FIG. 6), such that the lift mechanism 480 may impart vertical movement to the seat 102 over the range of movement of the scissor mechanism 412. A lift drive mechanism 481 may drive the scissor mechanism 412 to positions that correspond to the top portion 304 being in positions P1 and P2, as well as any position therebetween, as is described below in further detail with respect to FIGS. 7 and 8. However, in other embodiments, the lift mechanism 480 need not include a scissors lift and may include any desirable components or mechanisms to move the top portion 304 to and between positions P1 and P2.

In the particular embodiment shown in FIGS. 5 and 6, the scissor mechanism 412 includes two sets of elongate members 414 (disposed on either side of the lift drive mechanism 481). Each set of elongate members 414 includes two elongate members 416 that are coupled together at a central pivot 418. Each end of each elongate member 416 includes a wheel 420 that is movably received in either the top portion 304 of the carriage 300 or the bottom portion 302 of the carriage 300. Additionally, each pivot 418 is movably received within a lower stanchion 422 extending upwards from the bottom portion 302 of the carriage 300 and an upper stanchion 432 (one of which is omitted from FIG. 5 for clarity) extending downwards from the top portion 304 of the carriage 300. In particular, the lower stanchion 422 includes a slot 424 and the upper stanchion 432 includes a slot 434, both of which are configured to movably receive pivot 418.

FIG. 5 also illustrates dowels 442 and springs 444 that may extend between the top portion 304 and the bottom portion 302 of the carriage. In this embodiment, four dowels 442 extend between the top portion 304 and the bottom portion 302 and may ensure that the top portion 304 remains aligned with the bottom portion 302, both horizontally and rotationally. Thus, as the bottom portion 302 is rotated by rotation mechanism 450, the top portion 304 may also be rotated. Since the seat 102 is mounted atop of the top portion 304, this rotational alignment ensures that any rotational motion imparted to the lower portion 302 of the carriage 300 is also imparted to the seat 102. By comparison, the springs 444 may smooth/dampen the vertical movement of the top portion 304 with respect to the bottom portion 302 and/or vertically bias the top portion 304 with respect to the bottom portion 302. For example, springs 444 may be compression springs and may bias the top portion 304 to its raised position P2.

Figure 7:
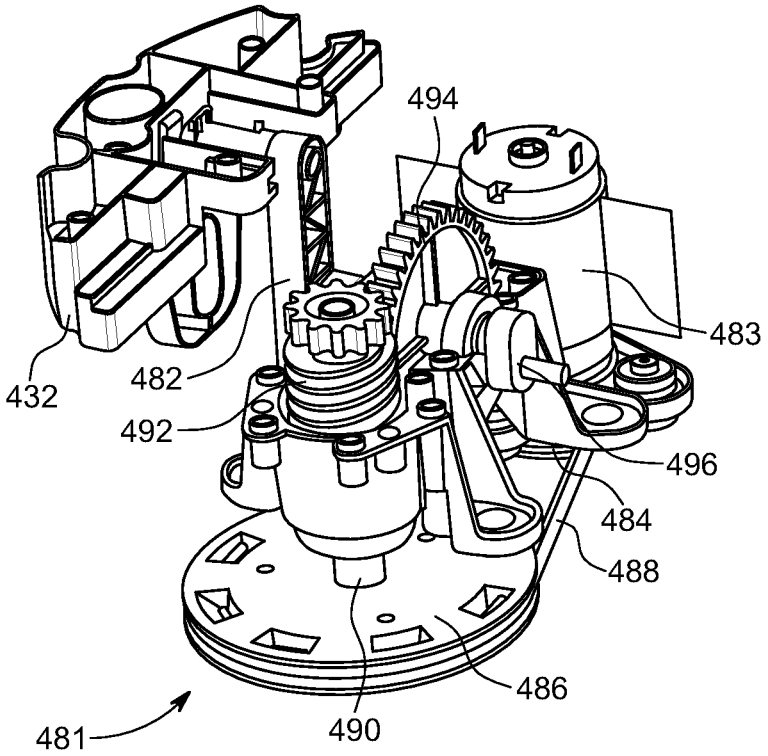
FIG. 7 illustrates a top perspective view of a drive mechanism included on the carriage shown in FIG. 5, with portions thereof removed for clarity.
Figure 8:
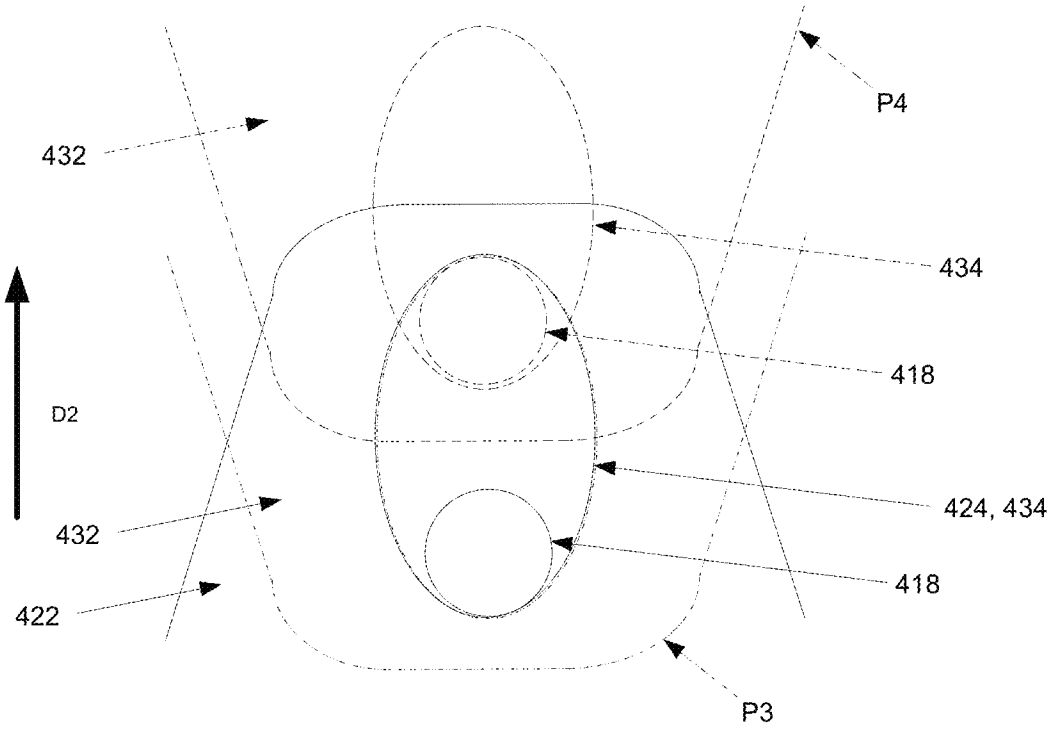
FIG. 8 illustrates an interaction between stanchions included on the carriage illustrated in FIG. 5.

Now referring to FIGS. 7 and 8, a top perspective view of the lift drive mechanism 481 and a side perspective view of stanchions 422 and 432 are shown, respectively, with various parts or components of the carriage 300 removed for clarity. Stanchion 422 and stanchion 432 are configured to allow the drive mechanism 481 to move the upper portion 304 between its raised position P2 and lowered position P1. As shown best in FIG. 7, each of the upper stanchions 432 are coupled to a cam member 482 that is driven by the drive mechanism 481 (only one stanchion 432 is shown for clarity). Consequently, upper stanchions 432 are configured to pull the pivots 418 upwards as they are driven upwards, thereby extending the scissor mechanism 412 and causing the scissor mechanism 412 to drive the top portion 304, as well as the seat 102, upwards. Similarly, as the upper stanchions 432 are either driven downwards or permitted to move downwards by the drive mechanism 481, the upper stanchions 432 may allow the pivots 418 to move downwards, thereby lowering the scissor mechanism 412 and the seat 102.

In particular, and as shown in FIG. 8, initially, when the top portion 304 of the carriage 300 is in its lowered position P1 the upper stanchions 432 are in a lowered position P3 (shown by lines with two dots and a dash (- . . -)) and the slot 434 of the upper stanchion 432 is aligned with the slot 424 of the lower stanchion 422. Then, as the upper stanchion 432 is driven upwards in direction D2 (by cam member 482), the upper stanchions 432 move upward, lifting the pivots 418 in direction D2. The stanchions 432 continue to move upwards (i.e., in direction D2) until the pivots 418 each reach the top of slot 424 (which is vertically fixed, since it is coupled to the bottom portion 302 which, is coupled to the lower housing 260 via the rotation mechanism 450), thereby restricting movement of the upper stanchion 432. When the pivots 418 reach the top of slot 424, the pivots 418 restrict further movement of the upper stanchion 432 and the upper stanchion is in its upper position P4 (shown in dashed lines (- - -)).

Now referring back to FIG. 7, in order to drive the cam member 482, the lift drive mechanism 481 includes a motor 483 that is coupled to the small pulley 484. As described above with respect to FIG. 4, the small pulley 484 drives a large pulley 486 (via belt 488), which drives an axle 490. Although not shown in FIG. 7 (for clarity), in the depicted embodiment, the motor 481 and axle 490 extend through the bottom portion 302; however, in other embodiments any components of the lift drive mechanism 481 may be disposed in any position in the infant support structure 100, including locations on the carriage 300 and/or the housing 250. Regardless of the locations, the axle 490 may drive a worm gear 492 which may drive a spur gear 494. The spur gear 494 may translate this rotational energy to an offset drive member 496 which may drive the cam member 482. Since the cam members 482 are fixed to the upper stanchions 432, the rotational movement of the offset drive members 496 may be translated into linear movement of the cam members 482, thereby causing the upper stanchion 432 to move up (and down) in the manner described above.

Figure 9:
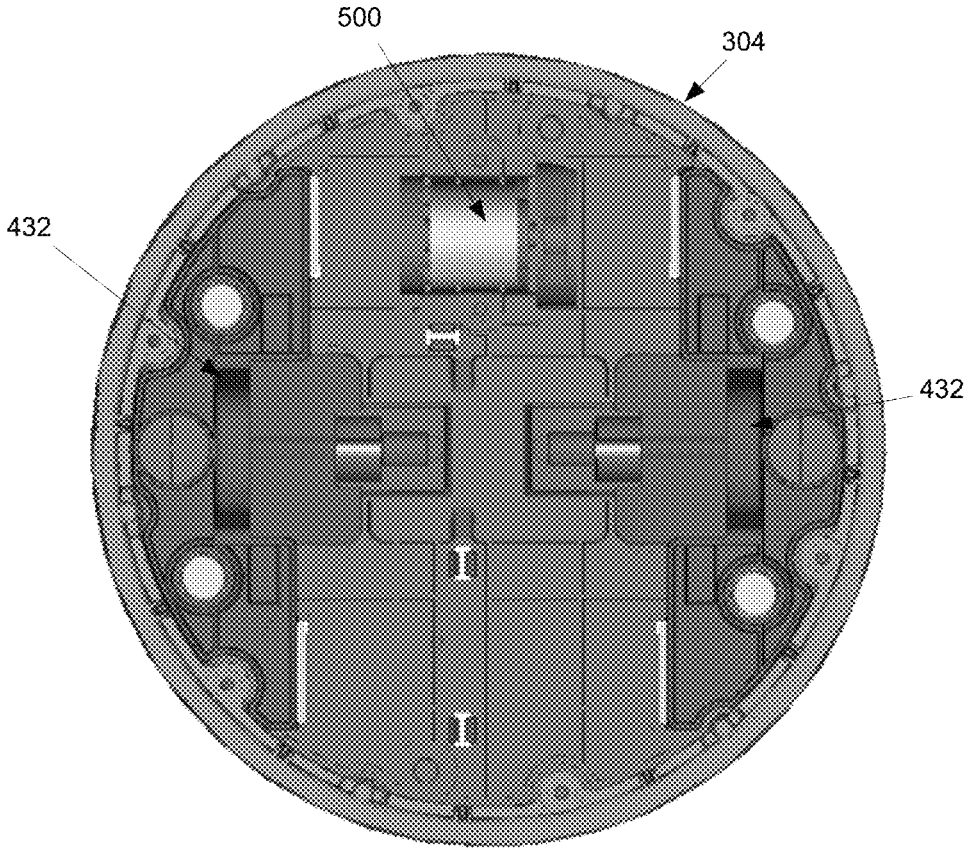
FIGS. 9 and 10 illustrate a bottom view and a side, sectional view, respectively, of a top portion of the carriage of FIG. 5.
Figure 10:
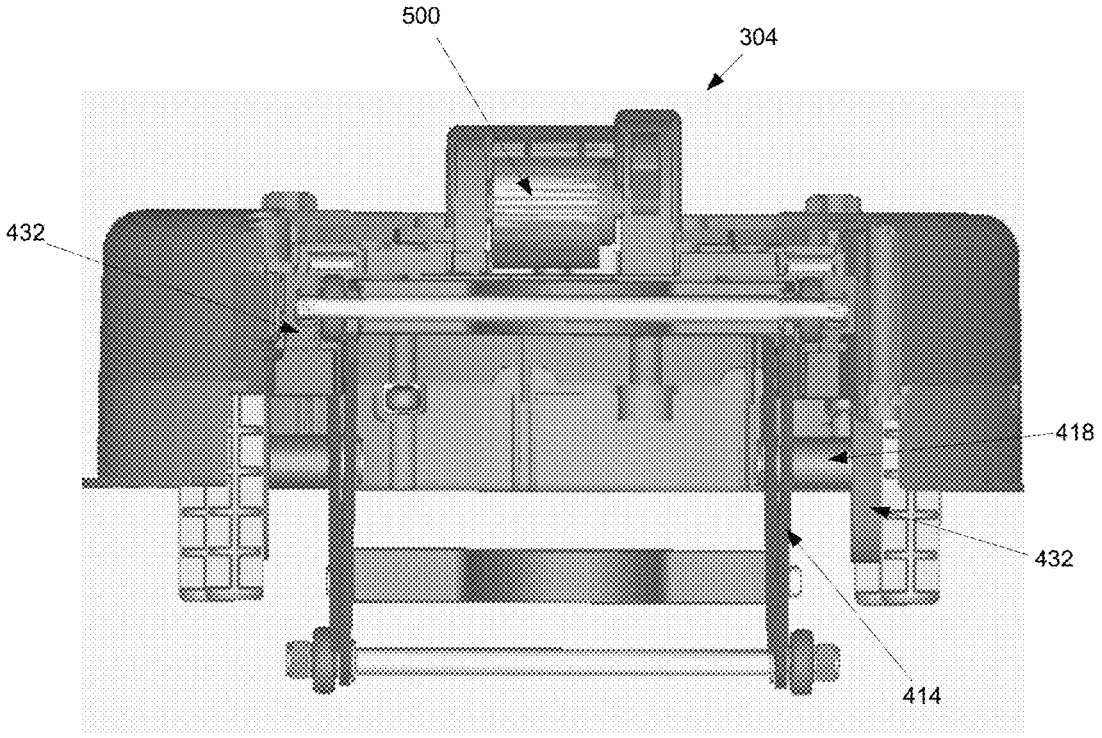

Referring next to FIGS. 9 and 10, bottom and side sectional view of the top portion 304 of the carriage 300 are shown, thereby illustrating the location of vibration mechanism 500. Most notably, although included at the very top of the top portion 304 of the carriage 300, the vibration mechanism 500 is included in the carriage 300. Consequently, the vibration mechanism 500 may receive power from the same power source as the lift mechanism 480 and the rotation mechanism 450.

For example, the infant support structure 100 may include a power adaptor that plugs into a wall outlet and converts alternating current (AC) power into direct current (DC) power, such as 12V power, that may be utilized to power the lift mechanism 480, rotation mechanism 450, and vibration mechanism 500. Consequently, in at least some embodiments, the infant support structure 100 can provide full movement functionality without a battery or batteries. At the very least, the vibration mechanism 500 may be powered by the same battery or batteries as the light mechanism 480 and rotation mechanism 450, such that only one power source needs to be monitored, charged, etc. By comparison, vibration mechanisms installed directly onto an infant seat of an infant support structure are typically installed separately and at a distance from any other mechanisms included on a powered infant support structure. Thus, typical vibration mechanisms must be powered with a separate power source, such as batteries, that may drain at different rates from a power source used to power other mechanisms included on the powered infant support structure.

Regardless of the power source used to power the vibration mechanism 500, the vibration mechanism 500 may be configured to provide customizable vibration patterns. In order to provide the customizable vibration patterns, the vibration mechanism may include an offset weight that may be driven at different speeds by a motor and/or any other components that can create desirable vibration patterns.

The components and configuration of the infant support structure 100 described herein enable the infant support structure 100 to provide bouncing, swiveling and/or vibrational movement to a child received in seat 102. For example, the rotation mechanism 450 may swivel the carriage 300 on track 284 in order to impart rotational movement (i.e., swivel) to the seat 102 as the lift mechanism 480 moves up and down to impart vertical movement (i.e., bounce) the seat 102, such that rotational and vertical movement are imparted to a child disposed in the seat 102 simultaneously. As another example, the rotation mechanism 450, lift mechanism 480, or vibration mechanism 500 may operate independently in order to impart a single motion (i.e., bouncing) to a child disposed in the seat 102. In other words, the lift mechanism 480, rotation mechanism 450, and vibration mechanism 500 may each be operable independently or in combination with any other mechanism.

In some embodiments, the rotation mechanism 450 may be configured to swivel the seat through approximately 90 degrees of rotation (i.e., 45 degrees offset from a rest position in each direction). However, in other embodiments, the rotation mechanism 450 may be configured to swivel the seat through approximately 60 degrees of rotation (i.e., 45 degrees offset from a rest position in each direction). Regardless, the lift mechanism 480 may bounce the seat 102 up and down during any portion of a swiveling motion or independently of the swiveling motion. Similarly, the rotation mechanism 450 may swivel or rotate the seat 102 back and forth during any portion of a bouncing motion or independently of the bouncing motion. Moreover, during any swiveling or bouncing motion, the vibration mechanism 500 may also impart vibrational motion to the seat 102.

Figure 11:
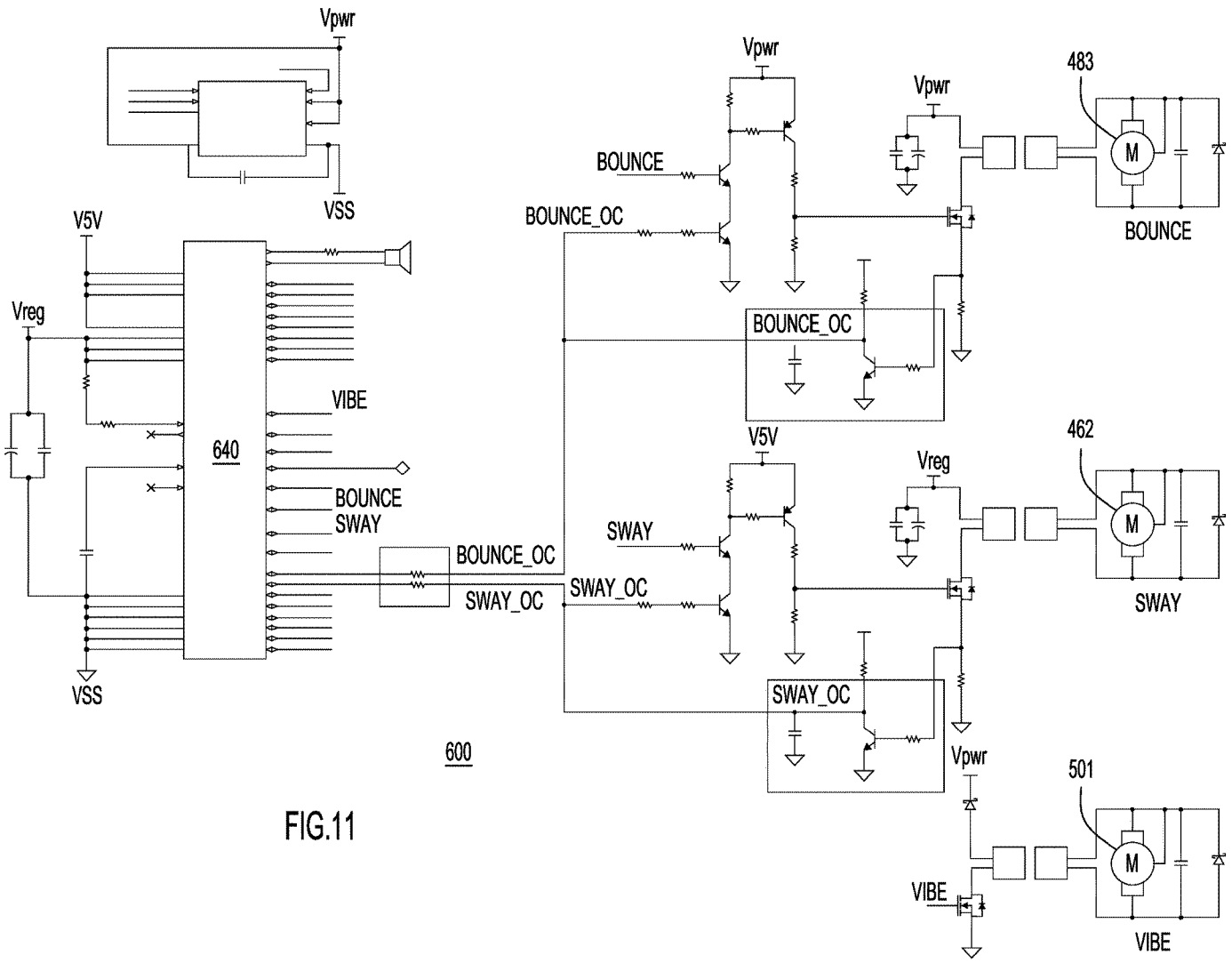

Now referring to FIGS. 11 and 12, the infant support structure 100 may further include an electronics assembly 600 adapted to control the motors included in the rotation mechanism 450, lift mechanism 480, and vibration mechanism 500 (i.e., motors 462 and 483) as well as to generate sensory stimulating output. FIGS. 11 and 12 collectively represent schematic diagrams of the electronics assembly 600 according to an embodiment of the present invention. Generally, the electronics assembly 600 may include a control unit having one or more switches or actuators that correspond to the various interactive features of the child support device 100, as described above. By way of example, as shown in FIGS. 11 and 12, the electronics assembly 600 includes a control unit 640 that is electronically coupled to bounce motor 483, swivel motor 462, and vibration motor 501, for each of the mechanisms included in movement mechanism 400.

The control unit 640 may control the parameters of each of the bounce motor 483, swivel motor 462, and vibration motor 501 independently, e.g., to set the speed at which the bounce, swivel, and vibration motors 483, 462, and 501 rotate the gear assemblies attached thereto and, as such, the speed at which the carriage 300 and seat 102 are rotated, lifted, and vibrated. By way of example, the speed control unit can be any suitable control circuit capable of varying the current to the motors 483, 462, and 501, such as a pulse width modulation control, a rheostatic control, etc. However, although each motor is controlled independently, the bounce motor 483, swivel motor 462, and vibration motor 501 may be operated (i.e., driven) simultaneously so that the infant support structure 100 may impart different combinations of movement types (i.e., swiveling and bouncing or bouncing and vibrating) and speeds (i.e., bouncing while swiveling at a first or second speed).

The electronics assembly 600 may also include additional switches and circuitry as desired to accommodate any other desired functionality. For example, the electronics assembly 600 may be configured to provide power to the control unit 640 of the infant support structure 100 (i.e., to turn the infant support structure 100 on and to provide power to a speaker, etc.). In the specific embodiment depicted in FIGS. 11 and 12, the electronics assembly 600 of the infant support structure 100 includes a power circuit 680 (shown in FIG.

12). The power circuit 680 may receive power from a power source that may comprise a DC source or AC source (e.g., a standard outlet plug or four "D-cell" batteries, perhaps included in a portable battery pack) and covert the power into power suitable for the movement mechanism, such as 12V power.

The electronics assembly 600 may also be configured to alter sensory output of the infant support structure 100. For example, in FIG. 12, the electronics assembly 600 associated with control panel 270 is shown. Switch circuit 660 may be configured to control the speed at which the seat 102 is rotated while switch circuit 672 may control the speed at which the seat 102 is bounced (i.e., moved vertically) and switch circuit 666 may control the vibrational speed, such that the rotation mechanism 450 and lift mechanism 4018 may be independently controlled. Meanwhile, switch circuits 662, 664, 668, and 670 may control other sensory outputs that may be included on the infant support structure 100. For example, the infant support structure 100 may include a speaker and switch circuits 662 and 664 may control the volume and selection of sound effects, respectively, while switch circuits 670 and 668 may control the volume and selection of music, respectively. Still further, switch circuit 650 may be configured to control the delivery of power to control unit 640 when the infant support structure is operatively coupled to a power source (i.e., switch circuit 650 is an on/off switch circuit). Each of these switch circuits may include lights or visual indicators associated with the various controls, as is described in more detail below with respect to FIG. 13.

The motors 483, 462, and 501 and the various switches and circuits described herein are each operatively connected to the control unit 640, which is capable of producing circuit- or switch-specific electronic output. The type of control unit 640 is not limited to that which is illustrated herein, and may include microcontrollers, microprocessors, and other integrated circuits. By way of specific example, the control unit 640 may comprise a processor mounted on an integrated circuit. The control unit 640 recognizes and controls signals generated by the various circuits, as well as generates and controls operational output directed through various sensory generating devices (e.g., the motors, the speaker, and the lights). The control unit 640 continually monitors the electronic status of the various switches, generating and altering the sensory output (e.g., movement, sounds, and/or lights) accordingly.

Figure 13:
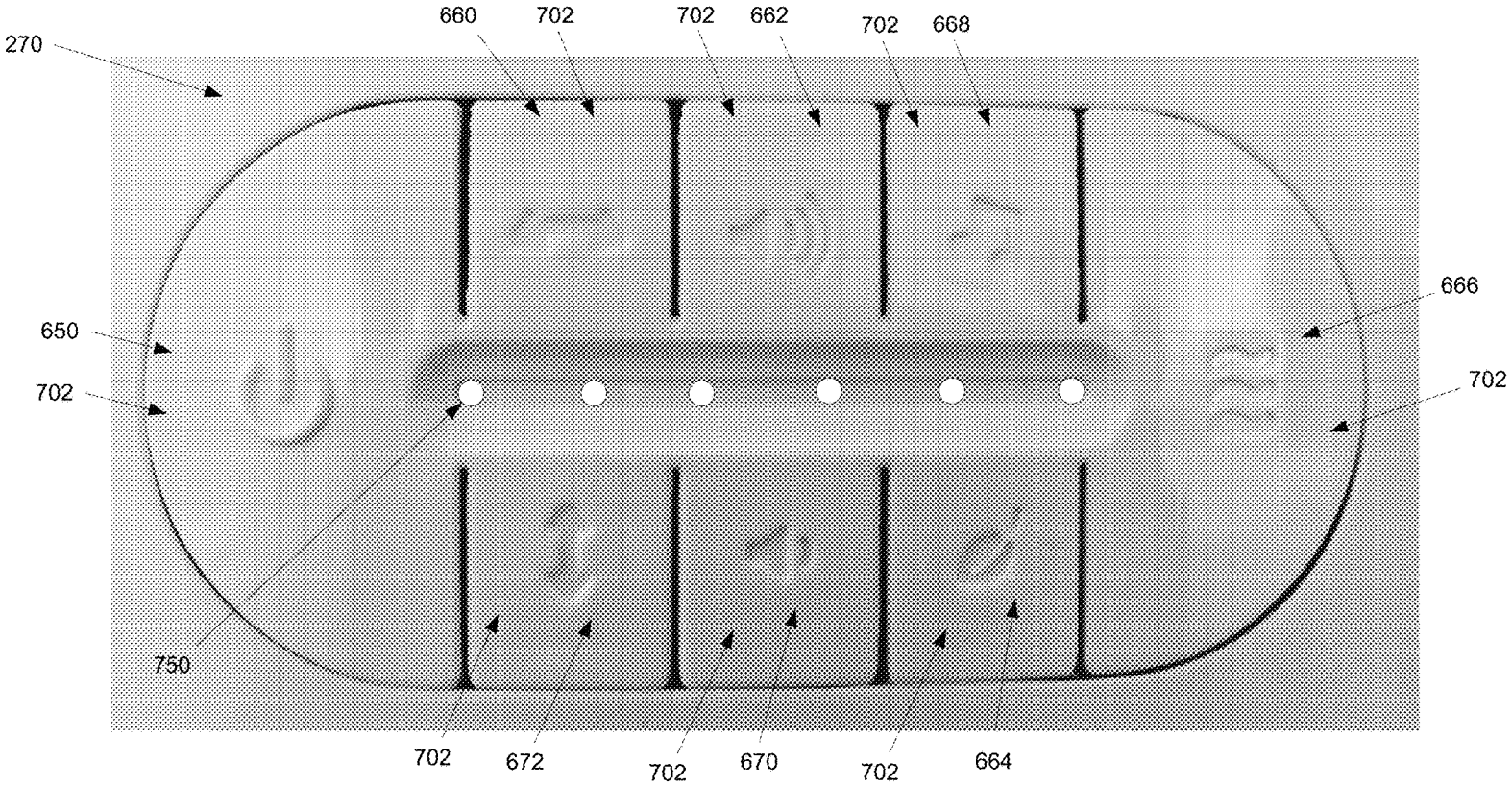
FIG. 13 illustrates a front perspective view of an external portion of a control panel included on the infant support structure of FIG. 1, according to an exemplary embodiment of the present invention.

Now referring to FIG. 13, a close-up view of an external surface of the control panel 270 is provided. The external surface of the control panel 270 includes a variety of toggle switches or buttons 702 configured to allow a user to interact with the circuitry 600 and, in particular, with the switch circuits included in the control panel 270 that are shown and described with respect to FIG. 12. The control panel 270 also includes a number of lights 750 that may indicate when a command is received from a parent or caregiver and/or the level at which a certain mechanism is operating, as is described in more detail below. In this particular embodiment, the lights 750 comprise six light emitting diodes (LEDs) that are configured to light up sequentially from left to right as a user cycles through the various modes or levels associated with a particular switch circuit.

In some embodiments, when a user initially powers on the infant support structure 100 (i.e., by pressing the button 702 associated with switch circuit 650), the infant support structure 100 may not impart any movement to a child seated in seat 102 and none of the lights 750 may be illuminated. In these embodiments, if a user (i.e., a caregiver) then toggles, presses, or otherwise actuates the button 702 associated with the switch circuit 672 for vertical movement, the switch circuit may 672 may relay a signal to the control unit 640, which may change (i.e., increase) the speed of the bounce motor 483 by one increment and illuminate the light 750 oriented furthest to the left. If the user presses or toggles the button associated with the switch circuit 672 for vertical movement again (regardless of any other buttons 702 actuated therebetween), the speed of the bounce motor 483 may increase another increment and the next light 750, moving left to right, may be illuminated.

In the depicted embodiment, this incremental speed and light increase may continue until the speed has increased six increments, to the maximum bounce speed, and all six lights 750 are illuminated. Then, the next actuation of the button 702 associated with the switch circuit 672 will reduce the speed of the bounce motor 483 back to the first increment (or to an off position) and reduce the number of illuminated lights 750 accordingly.

In other embodiments, powering on the infant support structure (i.e., by actuating the button 702 associated with switch circuit 650) may power on the infant support structure 100 with the bounce mechanism 480 moving at the first or last used increment. However, actuating the button 702 associated with the switch circuit 672 for vertical movement may still cycle the bounce mechanism 480 through the different speed increments (and illuminate the lights 750) in the same manner as described above (i.e., one level at a time). Moreover, regardless of the starting point, the same lighting and incremental/cyclical speed scheme may also be utilized with respect to rotational movement, such that the swivel motor 462 may be independently moved through six speed increments when the button 702 associated with switch circuit 660 is actuated (with lighting 750 indicating the current level).

In the depicted embodiment, the rotational speed and vertical speed can each be adjusted to six different speeds. Consequently, the infant support structure 100 may impart 36 different motion paths to a child disposed in seat 102 (i.e., six different speeds of rotation for each bouncing speed, and vice versa), without even accounting for vibrational movement. In some embodiments, the vibrational movement may also be toggled or incremented (via the button 702 associated with switch circuit 666) over six different levels and thus, the infant support structure may provide 216 different motion paths. However, in other embodiments, the infant support structure may toggle or cycle between any number of different speed levels in any desirable manner, provided that each of the rotation mechanism 450, lift mechanism 480, and vibration mechanism 500 is independently controllable/operable, but able to work in combination with any other mechanisms.

While the invention has been illustrated and described in detail and with reference to specific embodiments thereof, it is nevertheless not intended to be limited to the details shown, since it will be apparent to one skilled in the art that various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

For example, the infant support structure 100 can be of any size and shape. Any seat suitable to support a child may be used. The electronics assembly 600 in accordance with the present invention may include any combination of sensors, switches, lights, speakers, animated members, motors, and sensory output generating devices. The control unit 640 may produce any combination of audio and visual effects including, but not limited to, animation, lights, and sound (music, speech, and sound effects) in any output pattern. The electronics assembly 600 may also include additional switches or sensors to provide additional sensory output activation without departing from the scope of the present invention. Moreover, the motors described herein may comprise any motor operable to generate suitable motion of the carriage. By way of specific example the motor may comprise a normal magnet motor available from Mabuchi Motor Co., Ltd., Troy, Mich. (http://www.mabuchi-motor.co.jp/en_US/index.html).

Still further, the rotation mechanism 450, lift mechanism 480, and vibration mechanism 500 may include any desirable components or parts and may be disposed in any portion of the infant support structure, provided these mechanisms can impart motion to the seat 102 in the manner described herein. Moreover, the movement mechanism 400 could include additional mechanisms or components if desired, to impart additional layers or components of movement to the seat 102.

It is also to be understood that the infant support structure 100, or portions thereof may be fabricated from any suitable material, or combination of materials, such as plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof. For example, the material comprising the frame 110 is not limited to that illustrated herein, and may include tubes comprising any desirable metal (e.g., aluminum or steel).

Finally, it is intended that the present invention cover the modifications and variations of this invention that come within the scope of the appended claims and their equivalents. For example, it is to be understood that terms such as "left", "right" "top", "bottom", "front", "rear", "side", "height", "length", "width", "upper", "lower", "interior", "exterior", "inner", "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

What is claimed:

1. An infant support structure comprising:

a support base to support the infant support structure on a supporting surface;

a seat supported by the support base at a distance above the supporting surface;

a carriage at least partially housed in the support base;

a lift mechanism disposed on the carriage and configured to selectively impart vertical movement to the seat; and a rotation mechanism configured to, independently of the lift mechanism, rotate the seat about a pivot point by rotating the carriage, wherein the lift mechanism is configured to allow rotational movement to be imparted to the seat while the seat is undergoing vertical movement.

2. The infant support structure of claim 1, wherein the carriage further comprises:

a top portion; and a bottom portion, wherein the bottom portion is fixed in the XY plane and the lift mechanism is configured to impart the vertical movement to the seat by moving the top portion vertically.

3. The infant support structure of claim 1, wherein the carriage includes wheels configured to engage a track included in the support base, such that the carriage is rotatable on the track within the support base.

4. The infant support structure of claim 1, wherein the support base further comprises:

a housing including an interior cavity; and legs extending downwards from the housing, wherein the legs support the infant support structure on the supporting surface.

5. The infant support structure of claim 4, wherein the rotation mechanism is disposed within the interior cavity and the lift mechanism is configured to extend upwards out of the interior cavity.

6. The infant support structure of claim 1, further comprising:

a vibration mechanism configured to impart vibrational movement to the seat.

7. The infant support structure of claim 6, wherein the vibration mechanism, the lift mechanism, and the rotation mechanism are each powered by the same power source.

8. An infant support structure comprising:

a support base to support the infant support structure on a supporting surface;

a seat supported by the support base at a distance above the supporting surface;

a lift mechanism configured to selectively impart vertical movement to the seat; and a rotation mechanism configured to, independently of the lift mechanism, rotate the seat about a pivot point disposed within a lateral periphery of the seat, wherein the lift mechanism is configured to allow rotational movement to be imparted to the seat while the seat is undergoing vertical movement.

9. The infant support structure of claim 1, wherein the seat is mounted atop of the carriage.

10. An infant support structure comprising:

a support base to support the infant support structure on a supporting surface, the support base including a housing and a carriage operable to rotate relative to the housing, the carriage including a bottom portion and a top portion;

a movement mechanism including a lift mechanism configured to vertically move the top portion relative to the bottom portion and a rotation mechanism configured to, independently of the lift mechanism, rotate the carriage relative to the housing; and a seat coupled to the carriage and configured to receive an infant.

11. The infant support structure of claim 10, wherein the rotation mechanism rotates the carriage about a pivot point disposed within a lateral periphery of the seat.

12. The infant support structure of claim 10, wherein the seat is coupled to the carriage atop the top portion of the carriage.

13. The infant support structure of claim 12, wherein the seat is coupled to the top portion of the carriage via a recline mechanism that allows the seat to be repositioned between an upright seating configuration and a reclined seating configuration.

14. The infant support structure of claim 10, wherein the movement mechanism further comprises:

a vibration mechanism disposed in the top portion of the carriage.

15. An infant support structure comprising:

a support base including a housing and a carriage disposed at least partially within the housing;

a seat configured to receive an infant in a reclined or upright position, and a lift mechanism disposed on the carriage and configured to move a first portion of the carriage with respect to a second portion of the carriage in order to impart vertical movement to the seat, wherein the seat is mounted atop of the carriage and the carriage is configured to independently impart both rotational movement and vertical movement to the seat.

16. The infant support structure of claim 15, further comprising:

a rotation mechanism configured to impart the rotational movement to the seat via the carriage.

17. The infant support structure of claim 16, wherein the rotation mechanism is disposed in the housing and rotates the carriage about a fixed point disposed within a lateral periphery of the seat.

18. The infant support structure of claim 16, further comprising:

a vibration mechanism configured to impart vibrational movement to the seat.

* * * * *